United States Patent [19]

Clonch

[11] 4,073,445

[45] Feb. 14, 1978

[54] FEEDER CRUSHER

[75] Inventor: David Clonch, Tazewell, Va.

[73] Assignee: S & S Corporation, Cedar Bluff, Va.

[21] Appl. No.: 746,819

[22] Filed: Dec. 1, 1976

[51] Int. Cl.[2] ..... B02C 13/30

[52] U.S. Cl. ..... 241/101.7; 74/751; 241/186 R

[58] Field of Search ..... 241/101.7, 186 R, 189 R; 74/751

[56] References Cited

U.S. PATENT DOCUMENTS

| | | | |
|---|---|---|---|
| 2,881,642 | 4/1959 | Dodge | 74/751 |
| 3,540,308 | 11/1970 | Preston | 74/751 |
| 3,734,222 | 5/1973 | Bradwick | 74/751 X |
| 3,771,311 | 11/1973 | Herbst | 74/751 X |
| 3,899,941 | 8/1975 | Cook | 74/751 X |
| 3,983,950 | 10/1976 | Fabian | 241/101.7 X |

FOREIGN PATENT DOCUMENTS

| | | | |
|---|---|---|---|
| 2,455,072 | 5/1976 | Germany | 241/186 R |

*Primary Examiner*—Roy Lake
*Assistant Examiner*—Howard N. Goldberg
*Attorney, Agent, or Firm*—Cushman, Darby & Cushman

[57] ABSTRACT

A mobile, low-profile feeder-crusher machine for receiving, crushing and feeding freshly mined coal to a stationary conveyor system includes a rigid frame supporting a rotary crusher shaft and supporting an endless conveyor for delivering coal to the crusher shaft and for removing crushed coal therefrom. The drive system for the crusher shaft is mounted on the frame and includes a hydraulic pump driven by an electric motor, a hydraulic motor driven by the pump, a planetary gear reduction driven by the hydraulic motor and having a carrier output driving the crusher shaft, and a flywheel rotatable with the input of the reduction gear assembly.

2 Claims, 4 Drawing Figures

FEEDER CRUSHER

This invention relates to low-profile feeder-crushers for use in low-clearance coal mines and in particular to improvements in the drive system for rotating the crusher shaft so as to obtain more effective crushing without adding any appreciable weight or height to the machine.

BACKGROUND OF THE INVENTION

In coal mines where the coal exists in the form of relatively thin layers or seams it has long been the practice to employ coal-handling equipment which has a sufficiently low profile or height to be accommodated in the low-clearance areas formed as the coal is mined. One widely used mining technique includes the use of so-called feeder-crusher machines which rerecive freshly mined coal from a mining machine or haulage vehicle, crush the coal to a smaller more manageable size and feed it to a conveying system for removal from the mine.

Current feeder-crushers are mobile low-profile machines having a horizontally elongated hopper-like body fitted intermediate its ends with a rotary crusher. Horizontal transverse flights carried by a pair of endless chains continuously move along the floor of the body and in so doing they urge coal from the receiving end of the body to the rotary crusher and move the resulting crushed coal away from the crusher toward the rear end of the body where it is discharged. The discharged coal falls on to an endless conveyor which may be one of a series leading out of the mine. A typical feeder-crusher will not exceed about four feet in height in order that it can be maneuvered into a low-clearance space.

The body and the rotary crusher are interconnected with rigid frame members to form a unitary structure which supports the components of the power system required for operation of the machine. Typically, the entire structure is supported on a crawler-type propelling unit operated by a hydraulic or in some cases electric motor. Typically the power system includes an electric motor and a hydraulic pump driven by the motor. Electric current is supplied to the motor by cables leading into the mine. The pump supplies pressurized hydraulic fluid for operating the crawler unit and for operating a separate hydraulic motor which drives a speed reduction unit having its output connected to the rotary crusher shaft.

The rotary crusher is typically of the hammer mill or impact type in which a horizontal rotating shaft is provided along its length with a plurality of radial striker arms or hammers. The shaft is disposed transversely of the body of the machine, and as the coal is urged into the hammer circle between the shaft and the floor of the machine, by means of the moving flights, it is struck and crushed by the striker arms. The coal passes through the hammer circle only once, so that the arms are continually acting on fresh coal.

Since all of the material received by a feeder-crusher passes through the crushing assembly, the crushing of the coal must be carried out continuously and at a high rate if the machine is to operate effectively. The crusher is the limiting feature of the machine, because the conveyor system can be constructed to handle essentially any input load. Therefore, any increase in the ability of the crusher to handle a greater throughput increases the capacity of the machine. In addition it is important to reduce down-time due to jamming of the crusher or breakage of any part of the crusher drive system. Inherently the coal will include rock in varying amounts and the rock being harder and more resistant to crushing will sometimes tend to wedge between the floor of the machine and the breaker arms or will create very high strains in the drive system. The result can be jamming of the crusher and/or shearing of a shear pin which is typically inserted between the crusher shaft and the output shaft of the drive system. The machine is then out of operation until the fault has been remedied, and during this time loading of coal into the receiving end of the machine must stop, thereby reducing production.

The solution of the problems relating to increasing the throughput of a crusher system in a feeder-crusher and to reducing down-time resulting from jamming or breakage do not lie merely in increasing the size and power of the crusher system. The principal reason for this is that it is not practical or economical to install heavier and larger drive components and/or heavier and larger crusher shafts. As previously noted the height of the machine must be limited to about four feet; current construction techniques and the power requirements of the machines result in essentially all useable space being occupied. Further, the length, width and weight of the machines are limited as a result of the limited space in which the machines must operate.

SUMMARY OF THE INVENTION

The broad object of the invention is to improve the performance of a rotary impact type crusher, in terms of the ability of the crusher to process material at a greater rate and in terms of reduced jamming, without adding any appreciable size, weight of expense to the system. It is apparent from the nature of an impact type crusher that its performance can be improved by increasing the torque delivered by the crusher shaft, but the most straightforward means for doing this, that is, replacing the motor with one of greater power, lies outside the constraints of the stated object. It is known, also, that connecting a flywheel to a rotating shaft will effect high torque, and it is conventional in a number of environments to provide a flywheel on the work shaft of a machine, that is, on the relatively low speed output of whatever speed reduction system is driven by the power source.

In the case of a feeder-crusher machine for use in low clearance mines this modification is not feasible because calculations readily show that in order to increase the torque significantly a flywheel connected with the crusher shaft must be extremely large and heavy. For example, calculations for a typical crusher shaft rotating at 90 rpm show that to effect a 100% increase in torque a flywheel 10 feet in diameter and weighing 2100 pounds is required.

The present invention is based primarily on providing a flywheel on the input of the speed reduction system and secondarily on the selection of a planetary gear system as the speed reduction system. By connecting a flywheel to rotate with the input of the speed reduction system, that is, to rotate at high rotational speed relative to the more slowly rotating crusher shaft it is possible to achieve a significant increase in the torque of the crusher shaft with a flywheel of small size and mass. For example, to achieve the aforementioned 100% increase in torque a flywheel connected to the input shaft of the speed reduction system at the stated crusher shaft speed of 90 rpm need be only 20 inches in diameter and weigh only 228 pounds, assuming an input speed of 675 rpm. This increased torque has an exceptional ability to increase the throughput of the crusher and to reduce the tendency to jam. The crushing action of the arms or hammers on the coal and rock results from a combination of direct impact of the crusher arms with chunks of material and pinching of the chunks between the bottom of the body of the machine and the crusher arms. Since the proportion of rock and the size of the rock and coal in the material passing to the crusher vary continuously, there is a continuous variation in the stresses applied to the crusher shaft. Further, large chunks cannot pass through the crusher until they have been reduced in size, and as a consequence if a chunk does not break it will jam the crusher, causing damage to the latter or shearing of the shear pin. If the impact and pinching forces can be increased essentially instantaneously with increases in resistance to crushing then the crusher shaft will be much less apt to jam. This is precisely the effect which is produced by increasing the torque on the crusher shaft by means of the low-mass rapidly rotating flywheel arrangement of the present invention.

The increased torque produced by the flywheel arrangement of the present invention may, however, create a problem in that the torque is applied through the speed reducer, rather than directly to the massive crusher shaft. It has been established by calculation that the increased torque supplied by the previously described 228 pound flywheel connected to the input of the typical gear type speed reducer in current use on feeder-crusher machines will overstress the gears to the point of destruction during use. The solution to this problem does not lie in replacing the existing reducer with a more massive one of the same design, because this is inconsistent with the requirement of the invention that the weight and size of the overall feeder-crusher machine must not be increased to any appreciable extent. Rather, the problem is solved by replacing the typical speed reducer with a planetary gear reducer capable of withstanding the additional torque. This replacement does not result in an increase in size or weight of the overall machine, because the planetary system has a high strength-to-weight ratio. This aspect of a planetary system is exceedingly well adapted for the purpose of the invention because the stresses applied to the system can be readily transmitted to the already massive frame of the machine. In using a planetary system in a speed-reducing mode the ring gear is locked, the input is connected to the sun gear and the output is connected to the carrier. In the system contemplated by the present invention the ring gear need not ever rotate and may therefore be a permanent part of the frame. While a simple planetary system will suffice a compound system may also be employed.

DETAILED DESCRIPTION OF EXEMPLARY EMBODIMENT

The invention will be further understood from the following more detailed description taken with the drawings in which.

Figure 2:
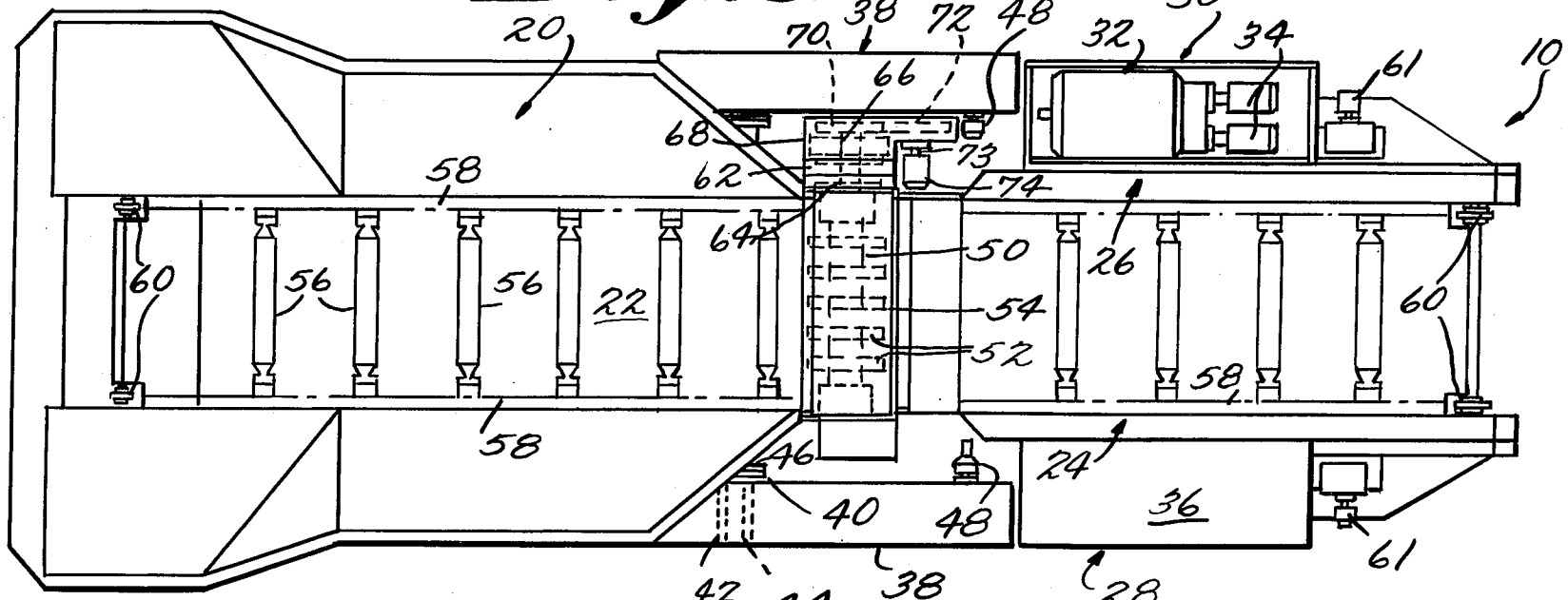
FIG. 2 is a schematic plan view of the machine of FIG. 1.
Figure 1:
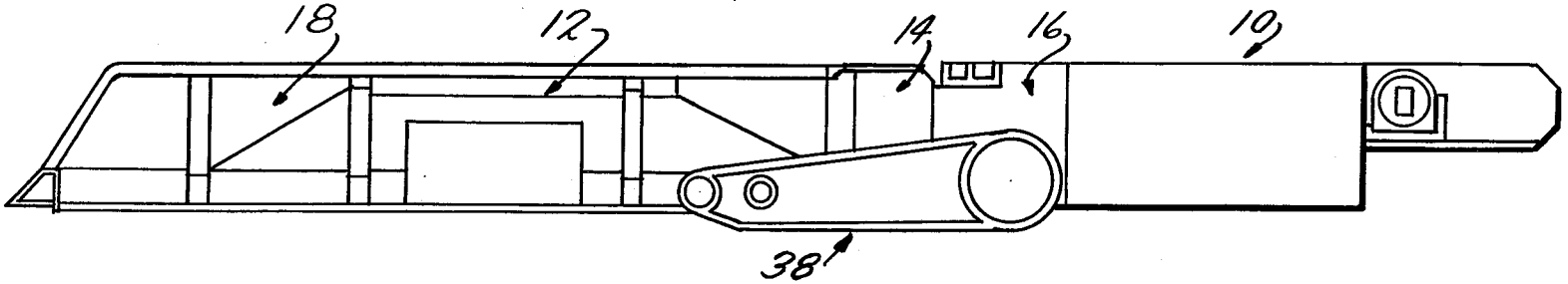
FIG. 1 is a schematic elevational view of a feeder-crusher machine.
Figure 4:
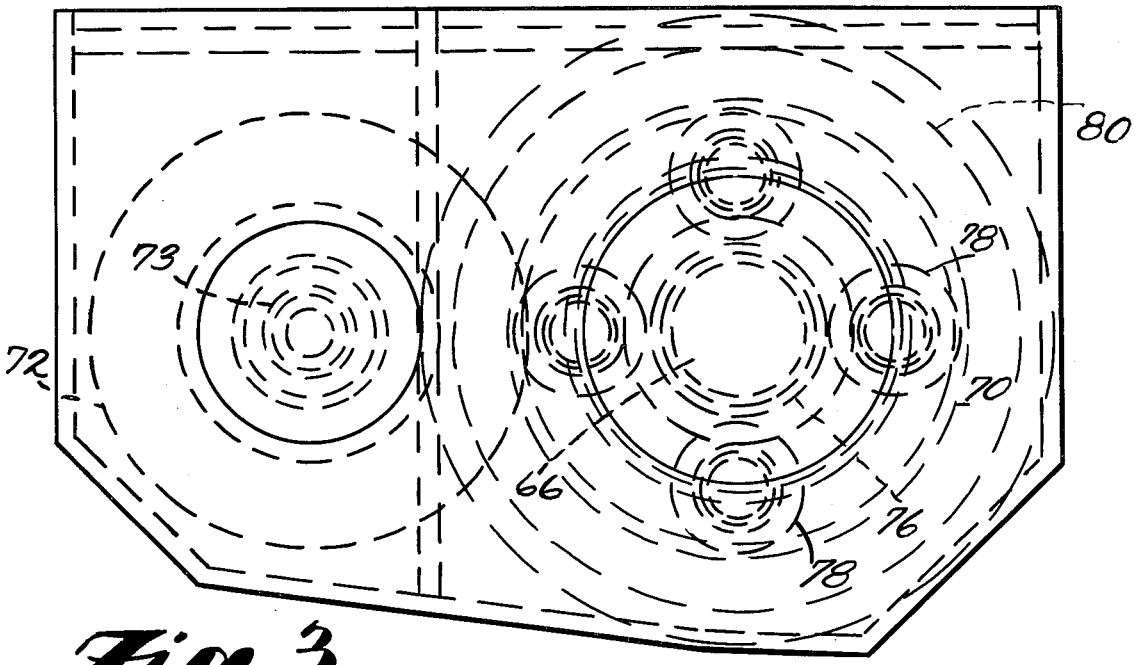
FIG. 4 is an end view of the drive system for the crusher.

FIGS. 1 and 2 illustrate a feeder-crusher machine 10 which includes as its major parts a receiving section 12, a crusher section 14 and a discharge section 16. The receiving section 12 is a hopper-like structure open at both ends and at the top and being formed of side walls 18 and 20 and a bottom wall 22, the latter extending the length of the machine and thereby forming the bottom wall of the crusher section 14 and of the discharge section 16. The discharge section 16 includes side walls 24 and 26 and lateral support shelves 28 and 30 for supporting the components of the power system, such as an electric motor 32, hydraulic pumps 34 and a reservoir 36 for the hydraulic system. In the interest of simplicity the connections between the pumps 34, the various hydraulic motors and the reservoir 36 are not shown.

The three sections 12, 14 and 16 together with various frame members form a unitary rigid body which is supported from the ground by two transversely-spaced endless-tread crawler units 38. The connection between each crawler unit 38 and the body is a tube and shaft-like assembly 40 having a tubular end 42 which is fixed to the frame of the unit 38 and a shaft end 44 which is bolt-connected to the body at 46 for limited rotation about a transverse horizontal axis. A hydraulic piston and cylinder unit (not shown) connected between the body and the frame of the crawler unit determines the angular position of the body relative to the crawler units 38. The drive system for each crawler unit 38 includes a hydraulic motor 48 which receives pressure fluid from one of the pumps 34.

The crusher section 14 includes a rigid horizontal shaft 50 mounted transversely in the machine and provided with a plurality of radial breaker arms 52 or hammers. The circle 54 defined by the outer ends of the arms 52 during rotation of the shaft 50 lies slightly above the bottom wall 22 of the machine so that coal and rock will be crushed in passing through the space between the circle 54 and the wall 22. During operation of the machine coal and rock are urged into this space by a series of longitudinally spaced apart transverse flights 56 which are moved from left to right along the upper surface of the bottom wall 22 by means of a pair of spaced-apart endless chains the upper run of which is illustrated at 58. The chains 58 are looped over sprockets 60 and are driven by hydraulic motors 61 powered from one of the pumps 34. The crushed material is then carried by the flights 56 from the crusher section 14 to the right hand end of the machine.

All of the above is generally conventional in feeder-crusher machines. According to the present invention the drive system for the crusher shaft 50 includes a planetary gear reduction unit 62 having a low speed output driving the crusher shaft 50 and having a high speed input carrying a flywheel 68. The input shaft 66 also carries a secondary input gear 70 which meshes with a primary input gear 72 carried by the shaft 73 of a hydraulic motor 74 driven by one of the pumps 34.

Figure 3:
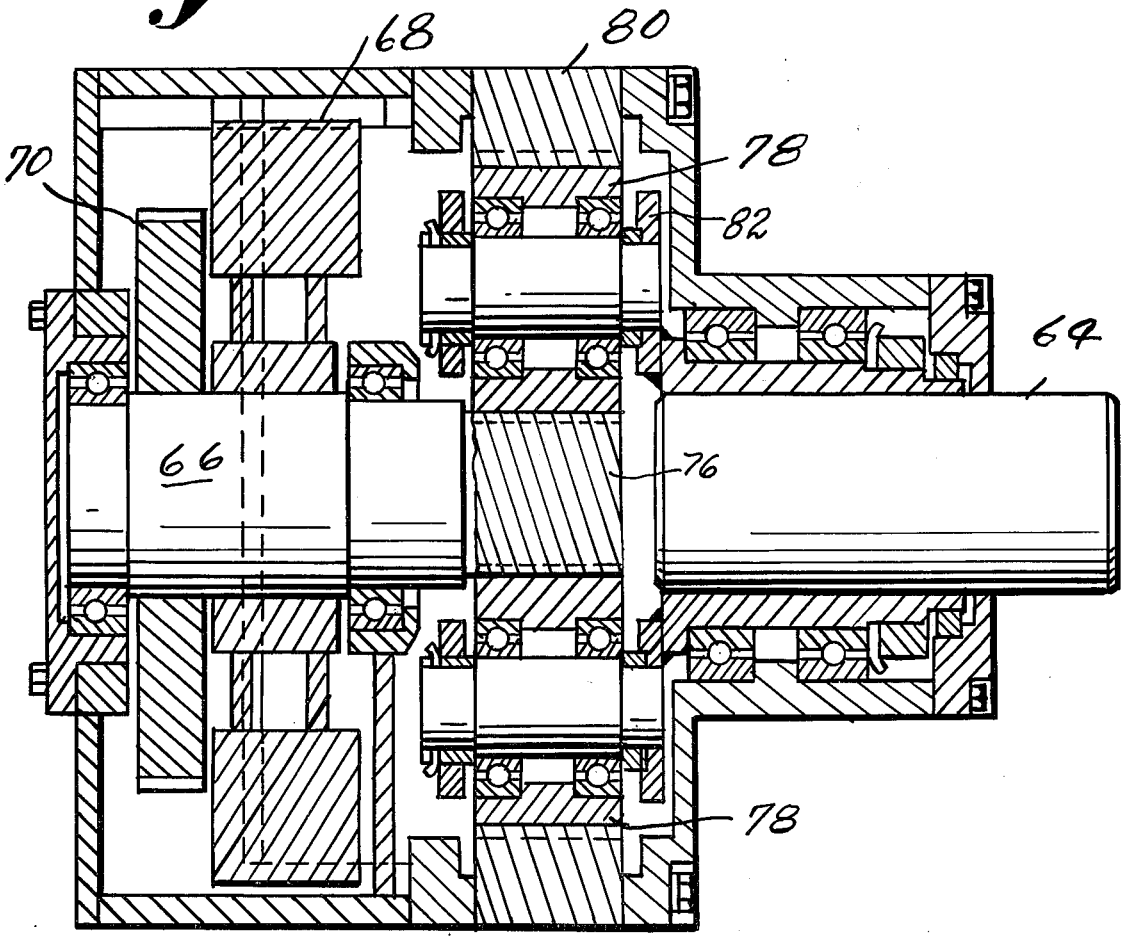
FIG. 3 is a sectional view on an enlarged scale of the drive system for the crusher.

As seen in FIG. 3 the planetary gear unit 62 includes a sun gear 76 carried on the input shaft 66 and four planet gears 78 meshing with the sun gear 76 and with an internally toothed ring gear 80. An end 64 of the crusher shaft 50 is carried by a planet gear carrier 82. The ring gear 80 is fixed against rotation, preferably by being made unitary with the body and/or frame of the machine.

In use the machine is propelled into a low-clearance mine area by means of the crawler units 38, under the control of an operator. Electric current for the motor 32 is supplied to the machine by a cable (not shown). The control valves for the various hydraulic motors are carried by the machine but are not shown inasmuch as they may be conventional features of a feeder-crusher. When the machine has been properly located, the sprocket motors 61 and the crusher motor 74 are set in motion and coal is loaded into the receiving section 14. The moving flights 56 urge the uncrushed coal into the hammer circle 54 of the crusher and then urge the coal crushed by the breaker arms 52 into the discharge section 16.

The system of flights 56 and chains 58 can be designed and constructed to transport the uncrushed and crushed coal at essentially any practical rate and the ability of the crusher is therefore the limiting feature of the machine's throughput. As described earlier this limiting feature is overcome to a large extent by providing a flywheel 68 at the high-speed input of the speed reducer so that the torque applied to the crusher shaft 50 is amplified by the rapidly rotating flywheel 68. The amplification is, of course, proportional to the weight and speed of the flywheel 68, and for a given crusher the weight of the flywheel to be used will be selected on the basis of the desired increase in torque, subject to the space available for the flywheel and the ability of the crusher to withstand higher stresses. Preferably the flywheel should produce a minimum increase of 25% in the torque applied to the crusher shaft, over that which is available without the flywheel. The speed reducer is preferably of the planetary gear type because this type of construction is capable of absorbing the high stresses which will develop when the amplified torque applied to the crusher shaft 50 overcomes a resistance which would cause jamming of the crusher if the amplified torque was not present.

It will be understood that the term flywheel means a discrete body of revolution of greater diameter and mass than the shaft on which it is carried. The flywheel may have its mass concentrated, ring-like, near its periphery as shown, or it may be a disc of uniform thickness.

What is claimed is:

1. A feeder-crusher machine for use in low clearance mines comprising an elongated low-profile body supported from the ground on traction means so as to be movable along the ground longitudinally, said body having side walls and a bottom and including, in end-to-end relationship along the length of the machine, a receiving section, a crushing section and a discharge section; said crushing section including a rotary crusher shaft mounted transversely in said body and carrying a plurality of radial breaker arms the outer ends of which define a circle spaced from a wall of the machine; means for urging material residing on said bottom in said receiving section to the space between said circle and said wall so as to be crushed therein and for urging the resulting crushed material along the discharge section in a direction away from said crusher section; and drive means mounted on said body for rotating said crusher shaft, said drive means including a constant-speed motor, a mechanical speed reduction unit having a high speed input driven by said motor, a low speed output driving said crusher shaft, a gear system connected between the input and the output for rotating the output at a speed proportional only to the speed of the input and a flywheel connected to rotate with said high speed input to said speed reduction unit whereby amplified torque produced by the high speed flywheel is transmitted through the gear connections in said reduction unit to the more slowly rotating crusher shaft.

2. A feeder-crusher as in claim 1 wherein said speed reduction unit includes a planetary gear set having a sun gear, another gear, planet gears meshing with said sun gear and said other gear and a planet carrier, said other gear being fixed to said body, said sun gear being driven by said motor and said carrier driving said low speed output.

* * * * *